US008878083B2

(12) United States Patent
Haruyama

(10) Patent No.: US 8,878,083 B2
(45) Date of Patent: Nov. 4, 2014

(54) BUTTON KEY ASSEMBLY AND ELECTRONIC APPARATUS THAT EMPLOYS THE BUTTON KEY ASSEMBLY

(75) Inventor: Masahiro Haruyama, Tokyo (JP)

(73) Assignee: Oki Data Corporation, Tokyo (JP)

( * ) Notice: Subject to any disclaimer, the term of this patent is extended or adjusted under 35 U.S.C. 154(b) by 1560 days.

(21) Appl. No.: 12/457,020

(22) Filed: May 29, 2009

(65) Prior Publication Data

US 2009/0322569 A1 Dec. 31, 2009

(30) Foreign Application Priority Data

Jun. 26, 2008 (JP) ..... 2008-167385

(51) Int. Cl.

| | |
|---|---|
| ***H01H 9/26*** | (2006.01) |
| ***H01H 13/72*** | (2006.01) |
| ***H01H 13/76*** | (2006.01) |
| ***H01H 13/7057*** | (2006.01) |
| ***H01H 13/88*** | (2006.01) |

(52) U.S. Cl.

CPC ..... *H01H 13/7057* (2013.01); *H01H 2221/054* (2013.01); *H01H 2223/0345* (2013.01); *H01H 2221/044* (2013.01); *H01H 13/88* (2013.01); *H01H 2221/074* (2013.01); *H01H 2221/062* (2013.01)

USPC ..... 200/5 A; 200/345

(58) Field of Classification Search

USPC ..... 200/5 A

See application file for complete search history.

(56) References Cited

U.S. PATENT DOCUMENTS

| | | | | |
|---|---|---|---|---|
| 6,555,774 | B1 * | 4/2003 | Nielsen | 200/343 |
| 6,580,044 | B2 * | 6/2003 | Ogawa et al. | 200/552 |
| 7,629,548 | B2 * | 12/2009 | Pippel et al. | 200/344 |
| 7,745,742 | B2 * | 6/2010 | Li et al. | 200/5 R |
| 2003/0164281 | A1 | 9/2003 | Hiraoka | |
| 2007/0209921 | A1 | 9/2007 | Li et al. | |

FOREIGN PATENT DOCUMENTS

| | | |
|---|---|---|
| JP | 2001-236852 | 8/2001 |
| JP | 2007-200668 A | 8/2007 |

* cited by examiner

*Primary Examiner* — Renee S Luebke
*Assistant Examiner* — Lheiren Mae A Caroc
(74) *Attorney, Agent, or Firm* — Rabin & Berdo, P.C.

(57) ABSTRACT

Button keys, resilient supports and a frame are molded in one piece such that the button keys are resiliently movable and are spaced apart by a gap. Each of the button keys includes an engagement portion. A case includes a button hole formed therein. The case is assembled to the frame such that the button keys are received in the button hole. After the case has been assembled to the frame such that the plurality of adjacent button keys are received in the button hole and such that the engagement portion abuts a perimeter portion of the button hole, the second gap being smaller than the first gap.

13 Claims, 19 Drawing Sheets

BUTTON KEY ASSEMBLY AND ELECTRONIC APPARATUS THAT EMPLOYS THE BUTTON KEY ASSEMBLY

BACKGROUND OF THE INVENTION

1. Field of the Invention

The present invention relates to a button key assembly of an operator panel incorporated in a variety of electronic equipment including copying machines, facsimile machines, personal computers, telephones, and gaming machines.

2. Description of the Related Art

Conventional electronic apparatuses include an operator panel that employs a variety of operational keys that allow a user to operate the electronic apparatus. Such apparatuses include copying machines, facsimile machines, personal computers, telephones, and gaming machines. An operator panel includes a variety of operational keys such as selection keys for selecting a variety of functions such as "ENTER" and "RETURN" for confirming the selection, and "BACK KEY" for returning to the immediately previous state. These keys are commonly arranged closely for the purposes of functionality and design.

If a plurality of operational keys is to be closely located, the keys should be, for example, molded from a resin material in one-piece construction for minimum manufacturing cost. The mold should be designed such that adjacent keys are spaced apart by a predetermined distance or a gap. This gap may cause the keys to rattle after they have been assembled as a key board, impairing the operability of the keyboard.

SUMMARY OF THE INVENTION

An objection of the present invention is to solve the aforementioned drawbacks, and to provide a keyboard that offers good operability.

Another object of the invention is to provide a keyboard in which adjacent keys are spaced apart by as short a distance as possible so that the operability of the keyboard is least affected and excellent operability is obtained.

A button key assembly, includes a frame, a plurality of adjacent button keys connected to the frame via a plurality of resilient supports such that the plurality of button keys are resiliently movable, and a case.

The plurality of adjacent button keys are connected to the frame via a plurality of resilient supports such that the plurality of button keys are resiliently movable. The plurality of resilient supports, the plurality of button keys, and the frame are formed in one-piece construction, and each of the plurality of button keys includes an engagement portion. The case includes a button hole formed therein. The case is assembled to the frame such that the plurality of button keys are received in the button hole. The plurality of adjacent button keys are spaced apart by a first gap before the plurality of adjacent button keys have been received in the button hole. The plurality of adjacent button keys are spaced apart by a second gap after the case has been assembled to the frame such that the plurality of adjacent button keys are received in the button hole and such that the engagement portion abuts a perimeter portion of the button hole, the second gap being smaller than the first gap.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

Figure 1:
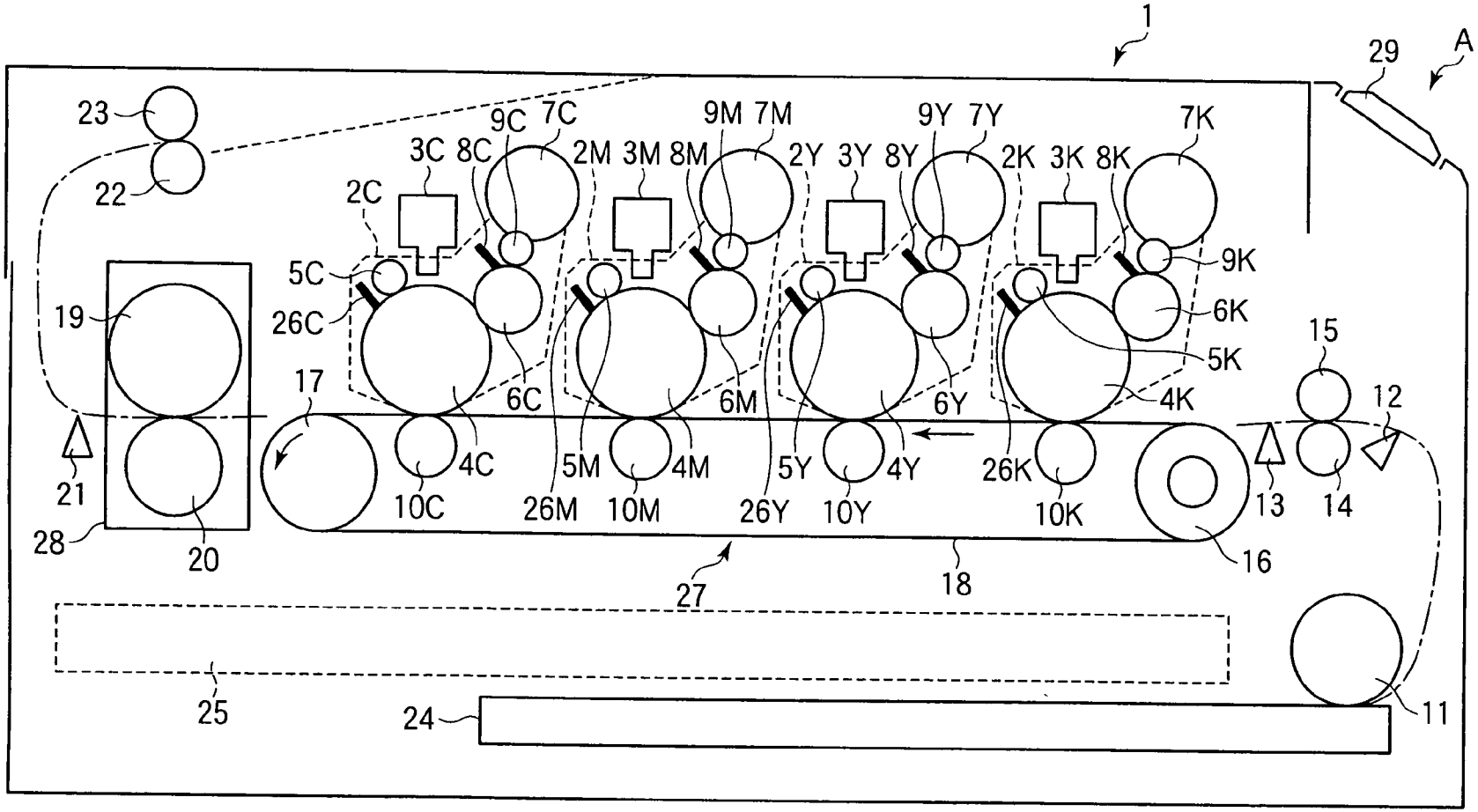
FIG. 1 illustrates a pertinent portion of an image forming apparatus of the invention.

FIG. 1 illustrates a pertinent portion of an image forming apparatus 1 that employs an operator panel 29 of a first embodiment.

Referring to FIG. 1, print engines 2K, 2Y, 2M, and 2C are aligned in this order in a direction of travel of paper. Transfer rollers 10K, 10Y, 10M, and 10C are disposed to face corresponding print engines 2K, 2Y, 2M, and 2C, respectively, such that an endless type transport belt 18 is sandwiched between the print engines 2K, 2Y, 2M, and 2C and the corresponding transfer rollers 10K, 10Y, 10M, and 10C. The transport belt 18 is disposed about a drive roller 17 and a driven roller 16. The transfer belt 18, drive roller 17, and driven roller 16 cooperate with one another to form a transfer unit 27. A paper cassette 24 holds a stack of paper therein. A feed roller 11 cooperates with a separator (not shown) to feed the top page of the stack of paper from the paper cassette 24. An entrance sensor 12 and a write sensor 13 are located upstream of transport rollers 14 and 15 with respect to the direction of travel of the paper, and downstream of the transport rollers 14 and 15. A fixing roller 19 incorporates a heat source such as a halogen lamp, and rotates in contact with a back up roller 20 so that a toner image on the paper is fused into a permanent image by heat and pressure.

The print engines 2K, 2Y, 2M, and 2C include LED heads 3K, 3Y, 3M, and 3C, photoconductive drums 4K, 4Y, 4M, and 4C, charging rollers 5K, 5Y, 5M, and 5C, developing rollers 6K, 6Y, 6M, and 6C, toner reservoirs 7K, 7Y, 7M, and 7C, developing blades 8K, 8Y, 8M, and 8C, and toner supplying rollers 9K, 9Y, 9M, and 9Y, respectively. The image forming apparatus 1 includes the operator panel 29 at a front portion of the image forming apparatus 1, allowing a user to input a variety of settings. The operator panel 29 will now be described in detail.

Figure 2:
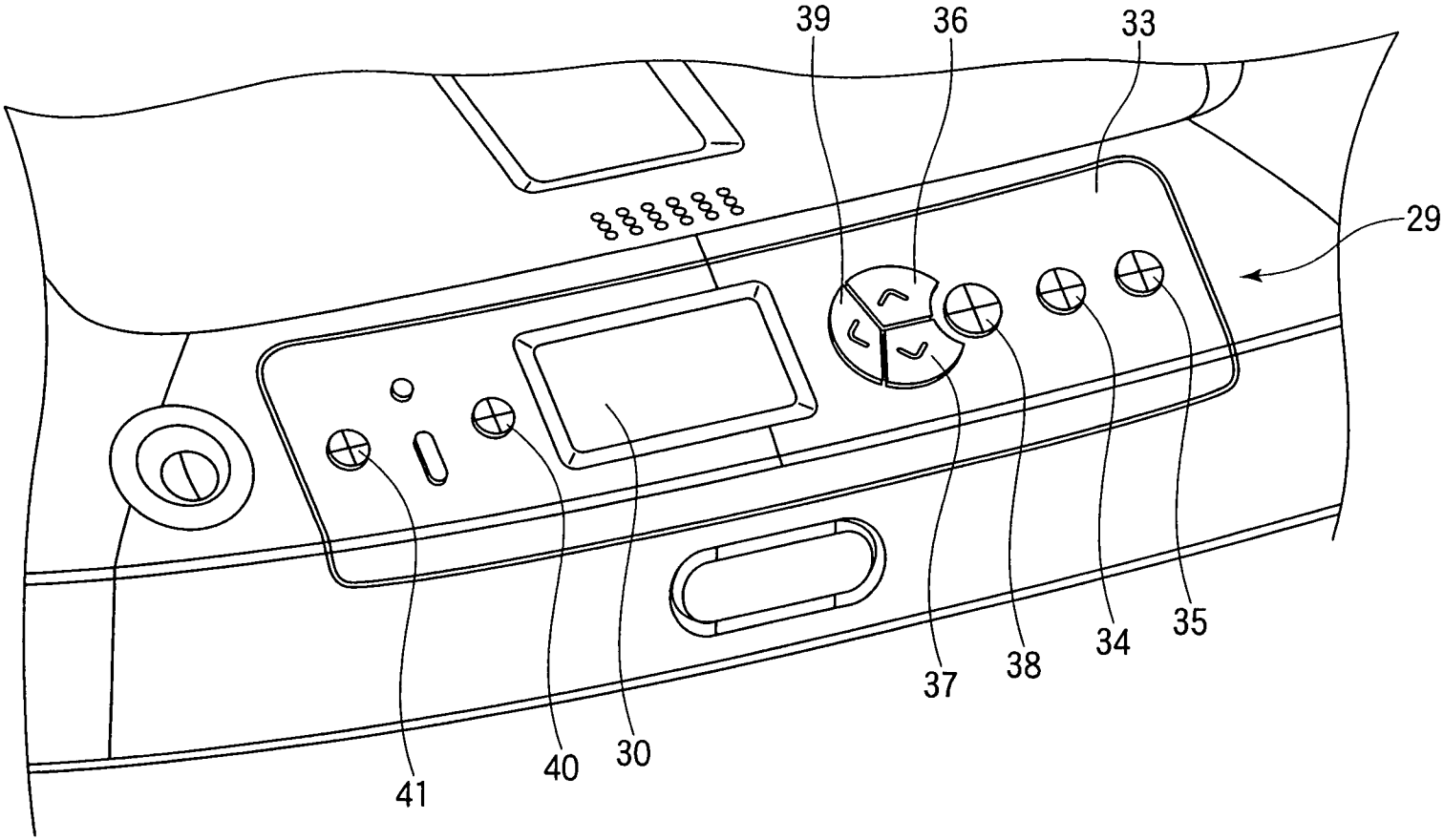
FIG. 2 is a perspective view of an operator panel as seen in a direction shown by arrow A of FIG. 1.

FIG. 2 is a perspective view of the operator panel 29 as seen in a direction shown by arrow A of FIG. 1.

Referring to FIG. 2, a display section 30 is, for example, a liquid crystal display (LCD), and displays the operational statuses and various settings of the image forming apparatus 1. An on-line key 34 may be switched between a reception mode where the image forming apparatus is ready for receiving information from a host apparatus and a non-reception mode where the image forming apparatus is not ready for receiving information from the host apparatus. A cancel key 35 is operated by the user if a printing operation should be halted in the middle of printing. Upper and lower menu keys 36 and 37 are operated to set the number of pages to be copied and the type of print medium. An enter key 38 is depressed for confirming various settings after making selection. A back key 39 is operated if the user wants to return to one immediately previous page of a screen that displays various settings. A help key 40 is operated for displaying the details of malfunctions such as paper jam. A shut down key 41 is depressed if the image forming apparatus 1 is to be turned off. The aforementioned keys depressed by the user are referred to as operational keys hereinafter.

Figure 3:
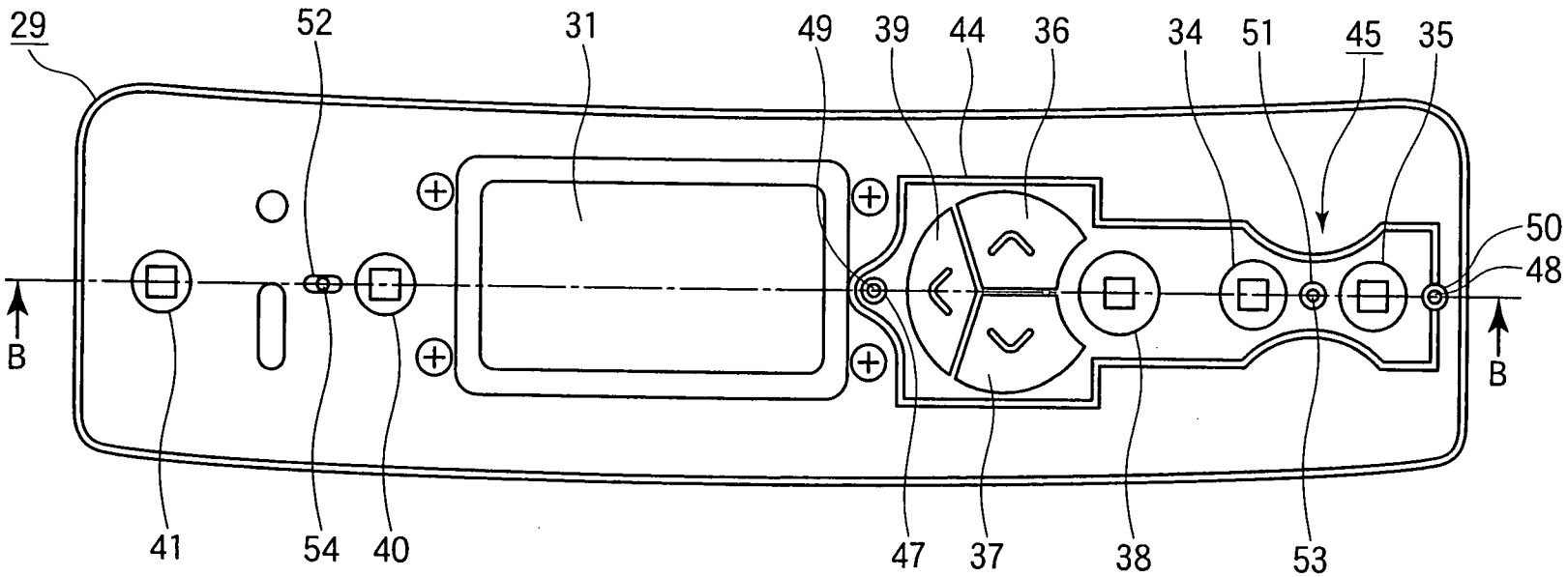
FIG. 3 is a front view of the operator panel.
Figure 4:
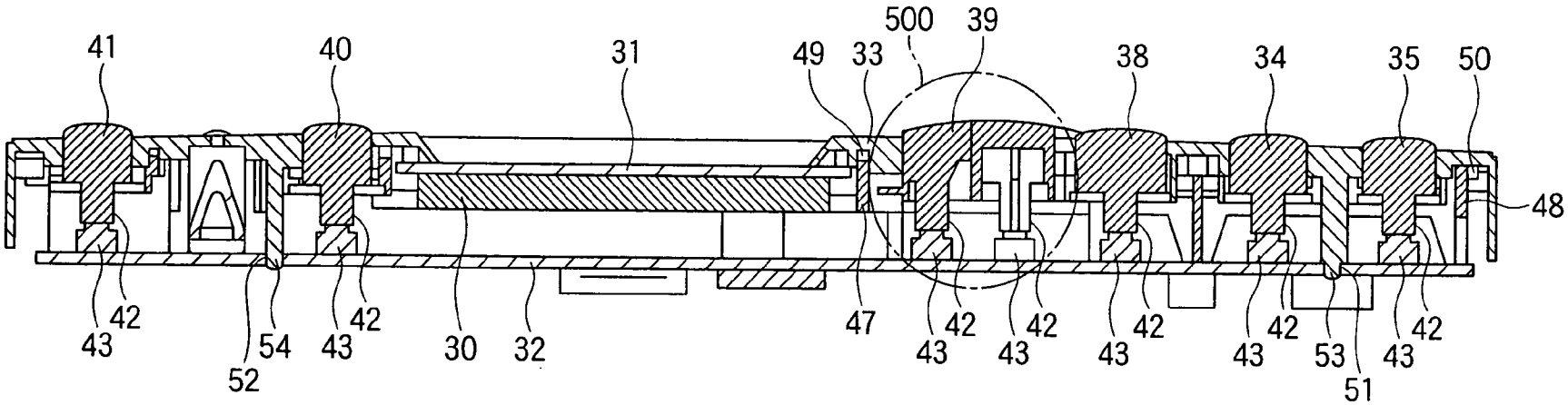
FIG. 4 is a cross-sectional view taken along a line B-B of FIG. 3.
Figure 5A:
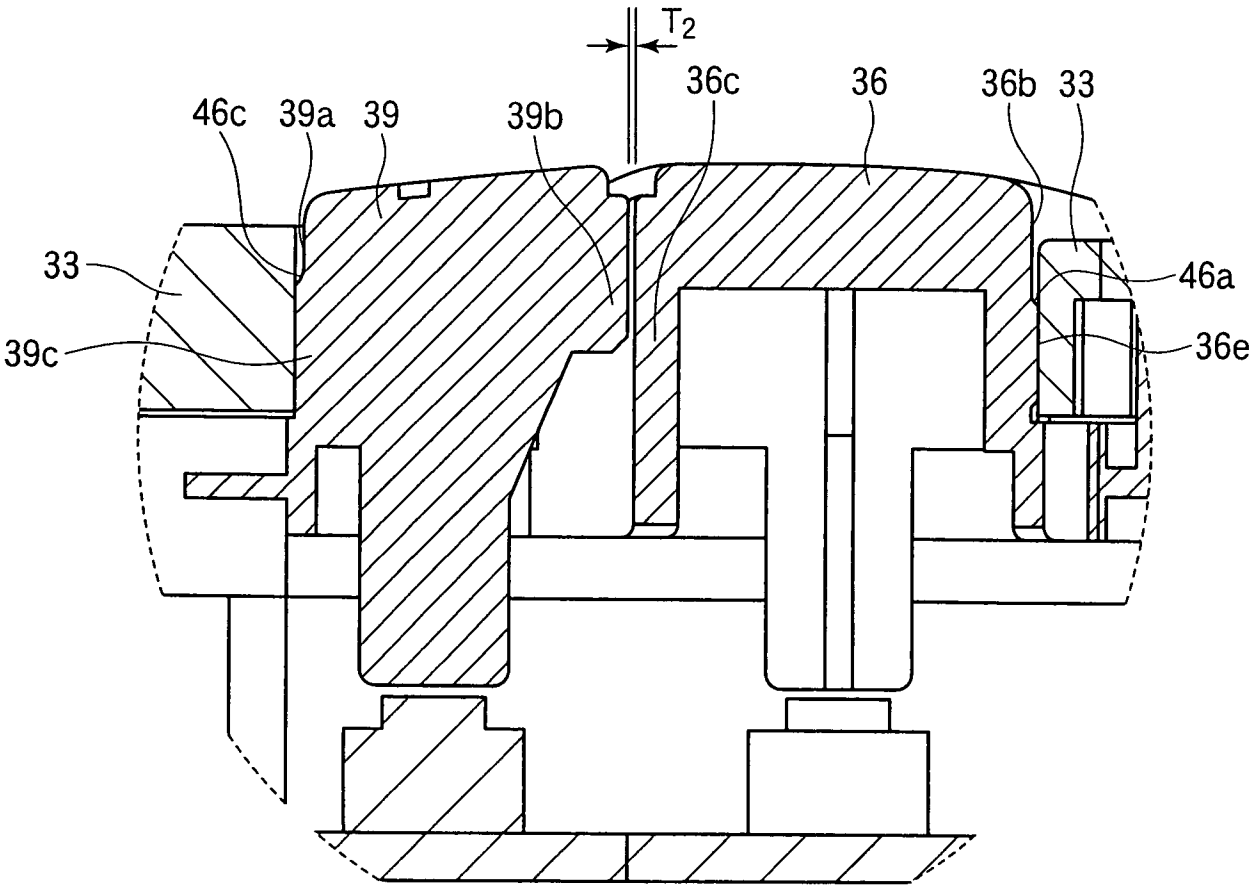
FIG. 5A is an expanded cross-sectional view of a portion of FIG. 4 encircled by a dot-dash line.
Figure 5C:
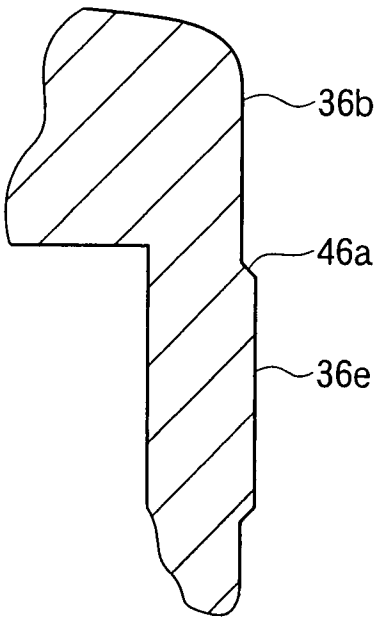
FIG. 5C is a partial expanded view of FIG. 5A.
Figure 5B:
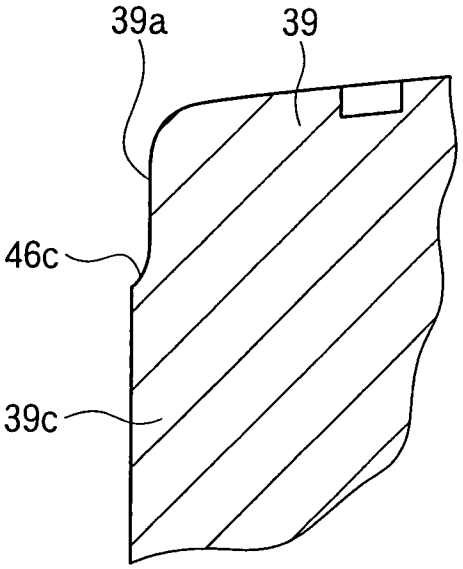
FIG. 5B is a partial expanded view of FIG. 5A.
Figure 6:
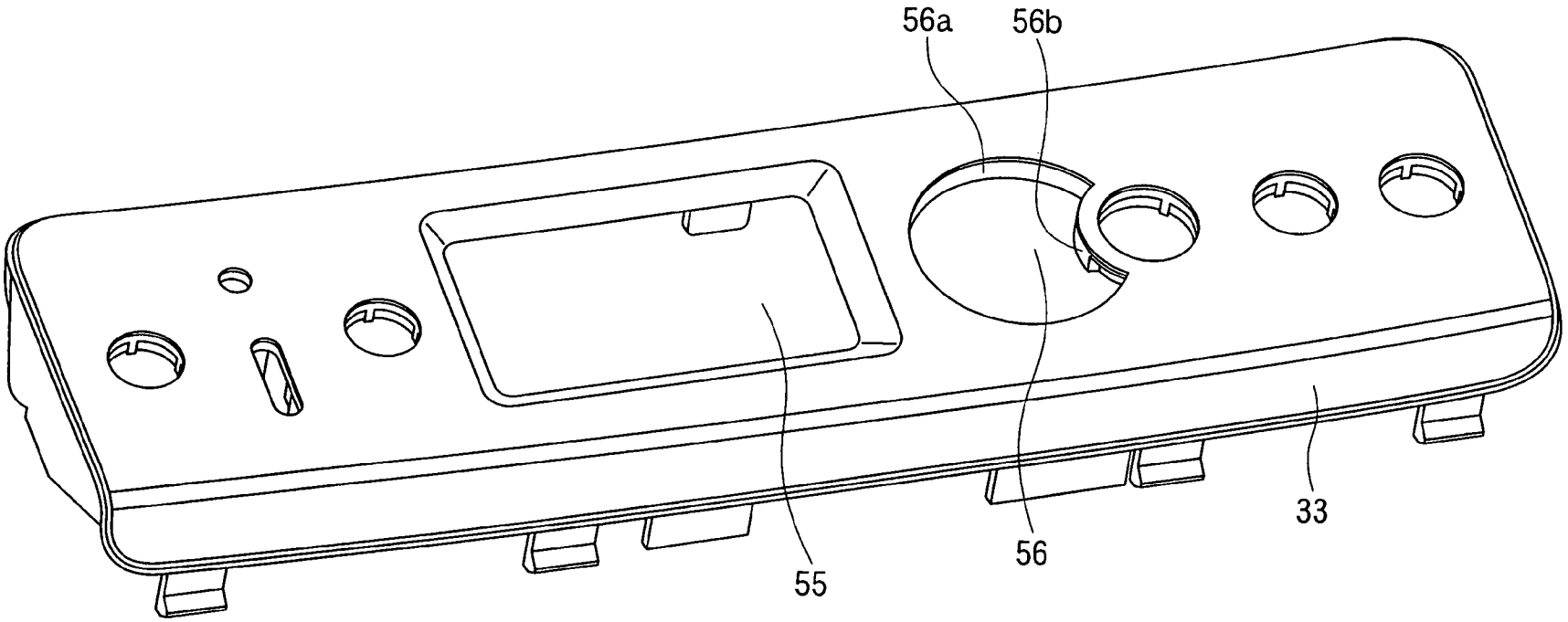
FIG. 6 is a perspective view of a case as seen obliquely from above.

FIG. 3 is a front view of the operator panel 29. FIG. 4 is a cross-sectional view taken along a line B-B of FIG. 3. FIG. 5A is a partial expanded cross-sectional view of a portion 500 of FIG. 4 encircled by a dot-dash line. FIG. 5B is a partial expanded view of FIG. 5A. FIG. 5C is a partial expanded view of FIG. 5A. FIG. 6 is a perspective view of the case 33 as seen obliquely from above.

Referring to FIGS. 3 and 4, the operator panel 29 includes a variety of sections in addition to the aforementioned display 30 and the operational keys 34-41. A display cover 31 is colorless and clear, and covers the front surface of the display 30. A circuit board 32 controls the information received from the operational keys 34-41. The case 33 accommodates the operational keys 39-41, display 30, display cover 31, and circuit board 32, and serves as an outer decorated panel. The operational keys 34-41 each include a pressing portion 42. The pressing portion 42 is immediately over a switch 43 mounted to the circuit board 32. When the operational keys 34-41 are depressed by the user, the switches 43 are shifted to their ON-position or OFF-position.

An on-line key 34, the cancel key 35, upper menu key 36, the lower menu key 37, the back key 39, the enter key 38, and a frame 44 are molded from, for example, a synthetic resin material in one piece construction such that these elements form a button key assembly 45 as a whole. The button keys assembly 45 will be described in more detail.

Figure 7:
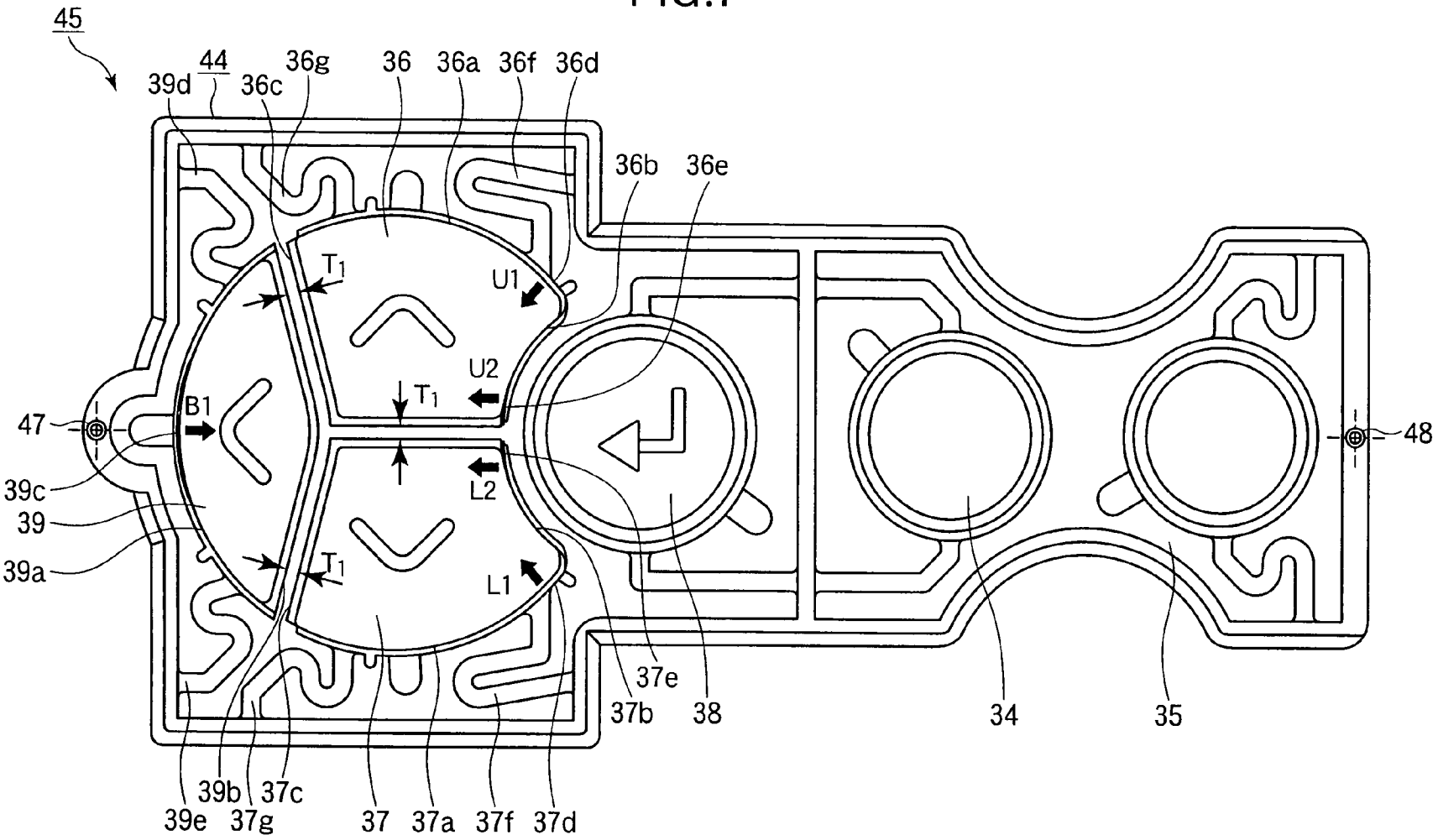
FIG. 7 is a front view of a button key assembly.
Figure 8:
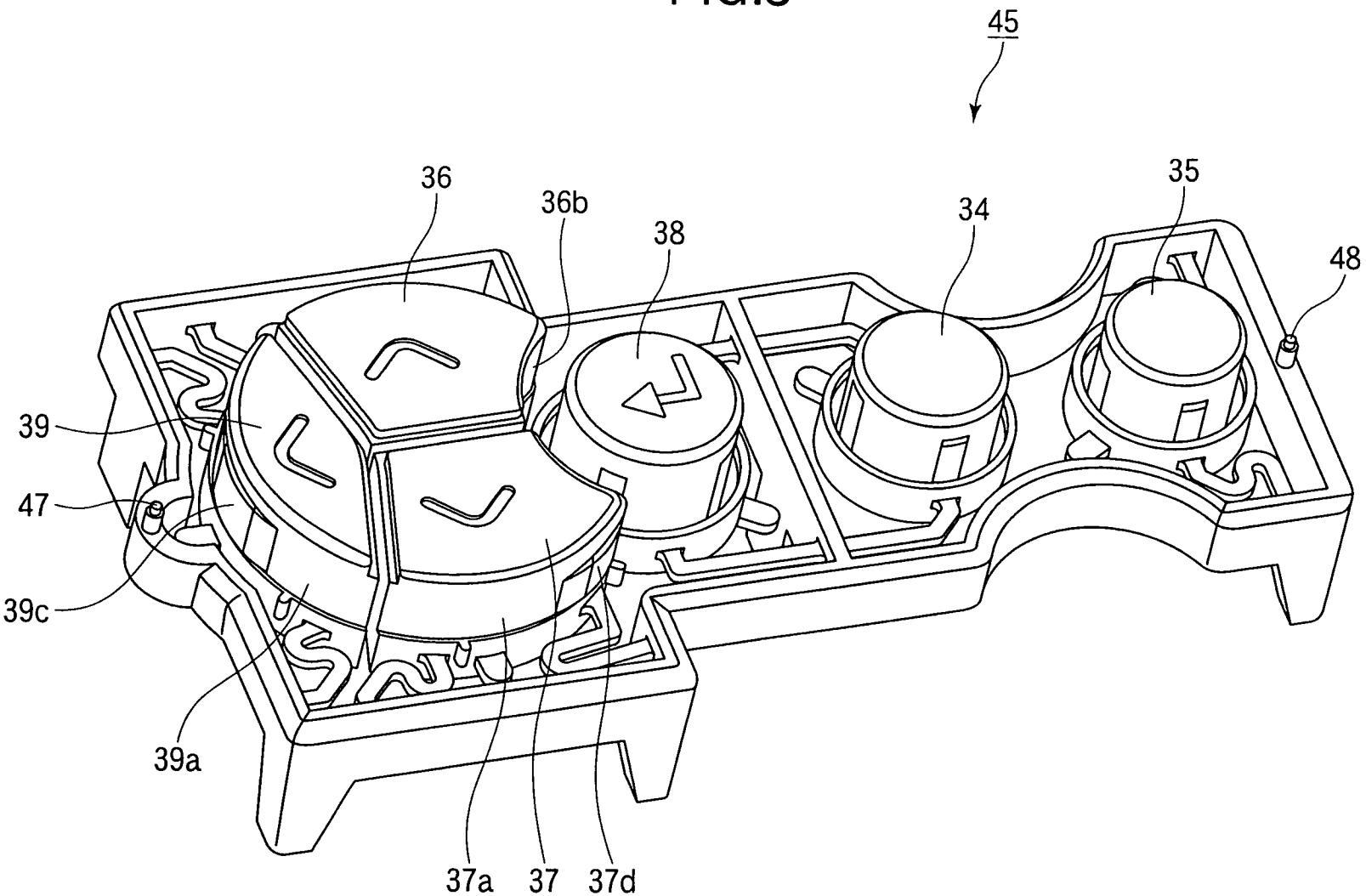
FIG. 8 is a perspective view of the button key assembly as seen obliquely from above.

FIG. 7 is a front view of the button key assembly 45. FIG. 8 is a perspective view of the button key assembly 45 as seen obliquely from above.

The operational keys 34-39 are in one piece with resilient supporting arms 36*f*, 36*g*, 39*d*, 39*e*, 37*g*, and 37*f* and the frame 44 such that the operational keys 34-39 may be displaceable by a predetermined short distance. Supporting arms 36*f* and 36*g* are formed between the upper menu key 36 and the frame 44. Supporting arms 37*f* and 37*g* are formed between the lower menu key 37 and the frame 44. Supporting arms 39*d* and 39*e* are formed between the back key 39 and the frame 44. It is to be noted that the upper key 36, lower key 37 and back key 39 are spaced apart from one another by a predetermined distance or a first gap T1 (e.g., 0.8 mm, FIGS. 7 and 12) before the button key assembly 45 has been assembled to the case 33. It is important that a mold used for one-piece molding of the button key assembly 45 has sufficient mechanical strength in all structural portions. In order to ensure sufficient mechanical strength of the mold, the portions of the mold corresponding to the first gap T1 should have a minimum, sufficient thickness. The configuration of the aforementioned operational keys 34-39 having the first gap T1 ensures mechanical and structural strength of the mold used for one-piece molding. The supporting arms each have one end fixed to the frame 44 and another end fixed to the corresponding operational keys, thereby supporting the operational keys such that the operational keys are resiliently movable in directions parallel to the direction in which the operational keys are depressed and in the directions substantially perpendicular to the directions in which the operational keys are depressed.

Figure 9:
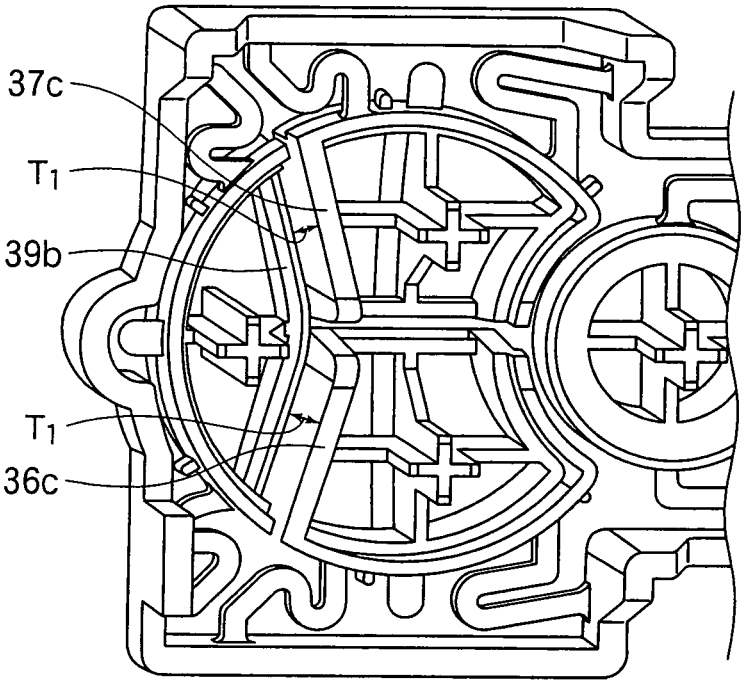
FIG. 9 is a perspective view of the button key assembly as seen obliquely from above.

FIG. 9 is a perspective view of the button key assembly 45 as seen obliquely from above.

Thus, as shown in FIG. 9, the first gap T1 exists between a back key wall portion 39*b* that extends from the surface of the back key 39 in a direction in which the back key 39 is depressed, and an upper menu key wall 36*c* that extends in the direction in which the upper menu key 36 is depressed. The first gap T1 also exists between the back key wall portion 39*b* that extends in the direction in which the back key 39 is depressed, and the lower menu key wall 37*c* that extends from the surface of the lower menu key 37*c* in the direction in which the lower menu key 37 is depressed.

Referring to FIGS. 5A-5B, 7, and 8, abutments 36*d* and 36*e* are formed on side surfaces 36*a* and 36*b* of the upper menu key 36. The abutments 36*d* (FIG. 5A) and 36*e* have short beveled surfaces 46*a* (FIG. 5C) that facilitate the movement of the upper menu key 36 when the button key assembly 45 is assembled to the case 33. Abutments 37*d* (FIG. 8) and 37*c* are formed on side surfaces 37*a* and 37*b* of the lower menu key 37. The abutments 37*d* and 37*e* have beveled surfaces 46*b* (not shown) that facilitate the movement of the lower menu key 37 when the button key assembly 45 is assembled to the case 33. An abutment 39*c*(FIGS. 5 and 8) is formed on a side surface 39*a* of the back key 39, and has beveled surfaces 46*c* (FIG. 5B) that facilitate the movement of the back key 39. The beveled surfaces 46*a*-46*c* should be formed at positions where the beveled surfaces are below the surface of the case 33 after the button assembly 45 has been assembled the case 33 for pleasant appearance of the keyboard.

Figure 10:
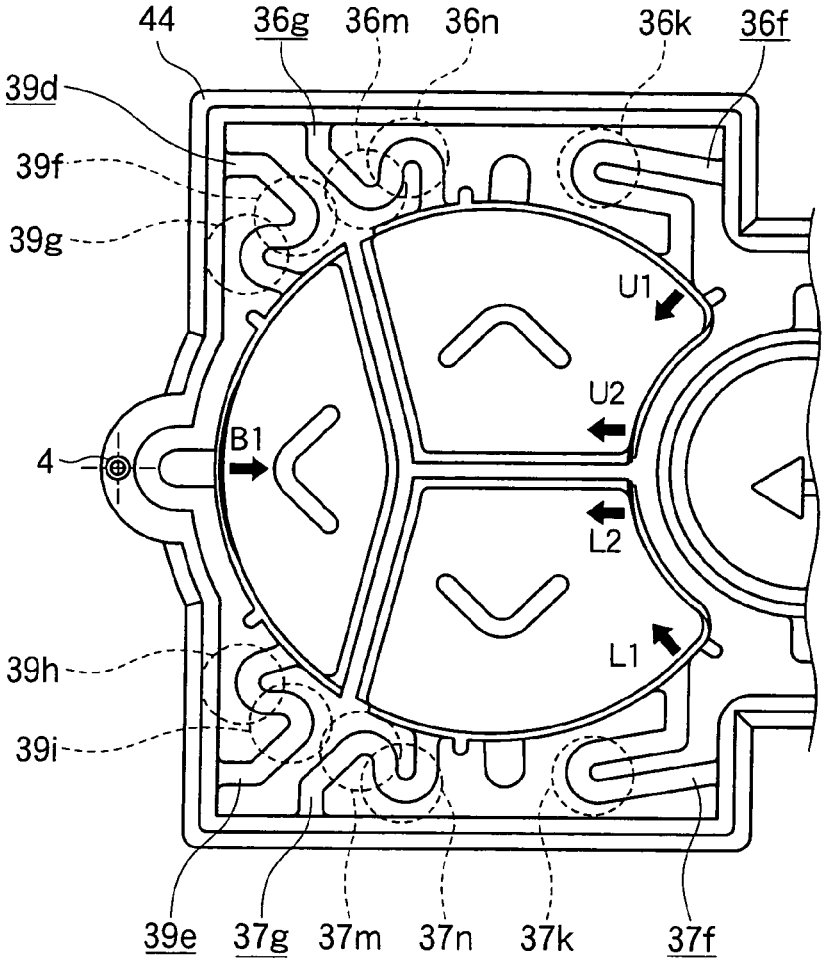
FIG. 10 illustrates the operation of the button key assembly.

FIG. 10 illustrates the operation of the button key assembly 45. Referring to FIG. 10, the supporting arm 36*g* and the supporting arm 36*f* connect the frame 44 and the upper menu key 36 together. The supporting arm 36*g* and the supporting arm 36*f* include knee bends 36*k* (sharply curved portions) and 36*n* and 36*m*, respectively, for providing resiliency that allows the upper menu key 36 to resiliently displace in directions shown by arrows U1 and U2. Likewise, the supporting arm 37*g* and the supporting arm 37*f* connect the frame 44 and the lower menu key 37 together. The supporting arm 37*g* and the supporting arm 37*f* include knee bends 37*k* (sharply curved portion) and 37*n* and 37*m*, respectively, for providing resiliency that allows the lower menu key 37 to resiliently displace in directions shown by arrows L1 and L2. Still likewise, the supporting arm 39*d* and the supporting arm 39*e* connect the frame 44 and the back key 39 together. The supporting arm 39*d* and the supporting arm 39*e* include knee bends 39*f* and 39*g* (sharply curved portion) and knee bends 39*h* and 39*i*, respectively, for providing resiliency that allows the back key 39 to resiliently displace in a direction shown by arrow B1.

As described above, the upper menu key 36, lower menu key 37, and back key 39 each include at least one knee bend in their corresponding supporting arms such that the knee bend provides resiliency of the key in specific directions. In other words, when external forces are exerted on the upper menu key 36, lower menu key 37, and back key 39, the knee bends resiliently deform such that these keys are allowed to resiliently displace in the U1 and U2 directions, the L1 and L2 directions, and the B1 direction, respectively.

Figure 11:
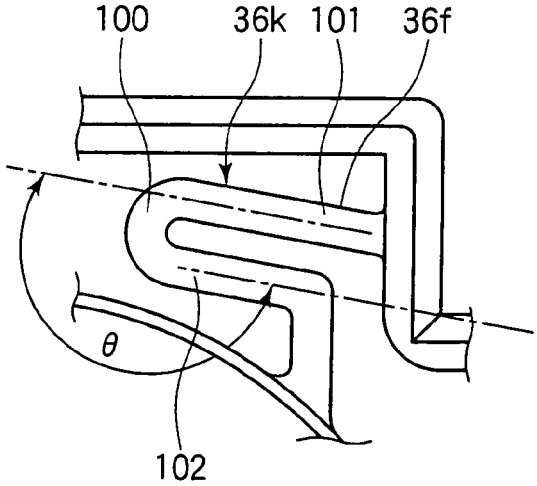
FIG. 11 illustrates an angle through which a portion of a supporting arm curves relative to another portion about a bent portion.

FIG. 11 illustrates an angle θ through which a portion 102 curves relative to a portion 101 about a bent portion 100. The respective knee bends are bent by the angle θ equal to or greater than 90 degrees and not larger than 180 degrees so that the respective supporting arms may be resiliently deformed without difficulty.

Referring back to FIGS. 3 and 4, the frame 44 includes a first post 47 (FIGS. 4 and 7) and a second post 48 that are located at longitudinal end portions of the frame 44 and at substantially midway between widthwise ends of the frame 44. When the button key assembly 45 is assembled to the case 33 (FIG. 6), the first and second posts 47 and 48 are fittingly received in a circular recess 49 and an elongated circular recess 50, respectively. The display section 30 is electrically connected to a circuit board 32 via cables (not shown). The display section 30 and the display cover 31 are securely mounted to the case 33 by means of, for example, screws (not shown) such that the display cover 31 covers the front side of the display section 30.

The circuit board 32 includes a round hole 51 and an elongated hole 52 spaced apart by a predetermined distance. The case 33 includes a first post 53 and a second post 54 formed thereon, and received in the round hole 51 and elongated hole 52, respectively. The circuit board 32 is fixed to the case 33 by means of, for example, screws.

Referring to FIG. 6, the case 33 includes a single button hole 56 for receiving the upper menu key 36, lower menu key 37, and back key 39 therein, and includes no partitions that isolate these operational keys from one another. The button hole 56 has a perimeter portion 56*a* and a perimeter portion 56*b*.

The engagement relation among the button hole 56, the abutments 36*d* and 36*e* of the upper menu key 36, the abutments 37*d* and 37*e* of the lower key 37, the abutment 39*c* of the back key 39 will be described.

The upper menu key 36, lower menu key 37, and back key 39 are spaced apart from one another by the first gap T1 (e.g., 0.8 mm) before the button key assembly 45 is assembled to the case 33. The side surface 36*a* of the upper menu key 36, side surface 37*a* of the lower menu key 37, and side surface 39*a* of the back key 39 have a radius of curvature substantially the same as the surface of the perimeter portion 56*a* of the button hole 56, so that the side surfaces 36*a* and 37*a* may comfortably slide on the perimeter portion 56*a* once the button key assembly 45 has been assembled to the case 33. Likewise, the side surface 36*b* of the upper menu key 36 and the side surface 37*b* of the lower menu key 37 have a radius of curvature substantially the same as the surface of a perimeter portion 56*b* of the button hole 56, so that the side surfaces 36*b* and 37*b* may comfortably slide on the perimeter portion 56*b*.

Figure 12A:
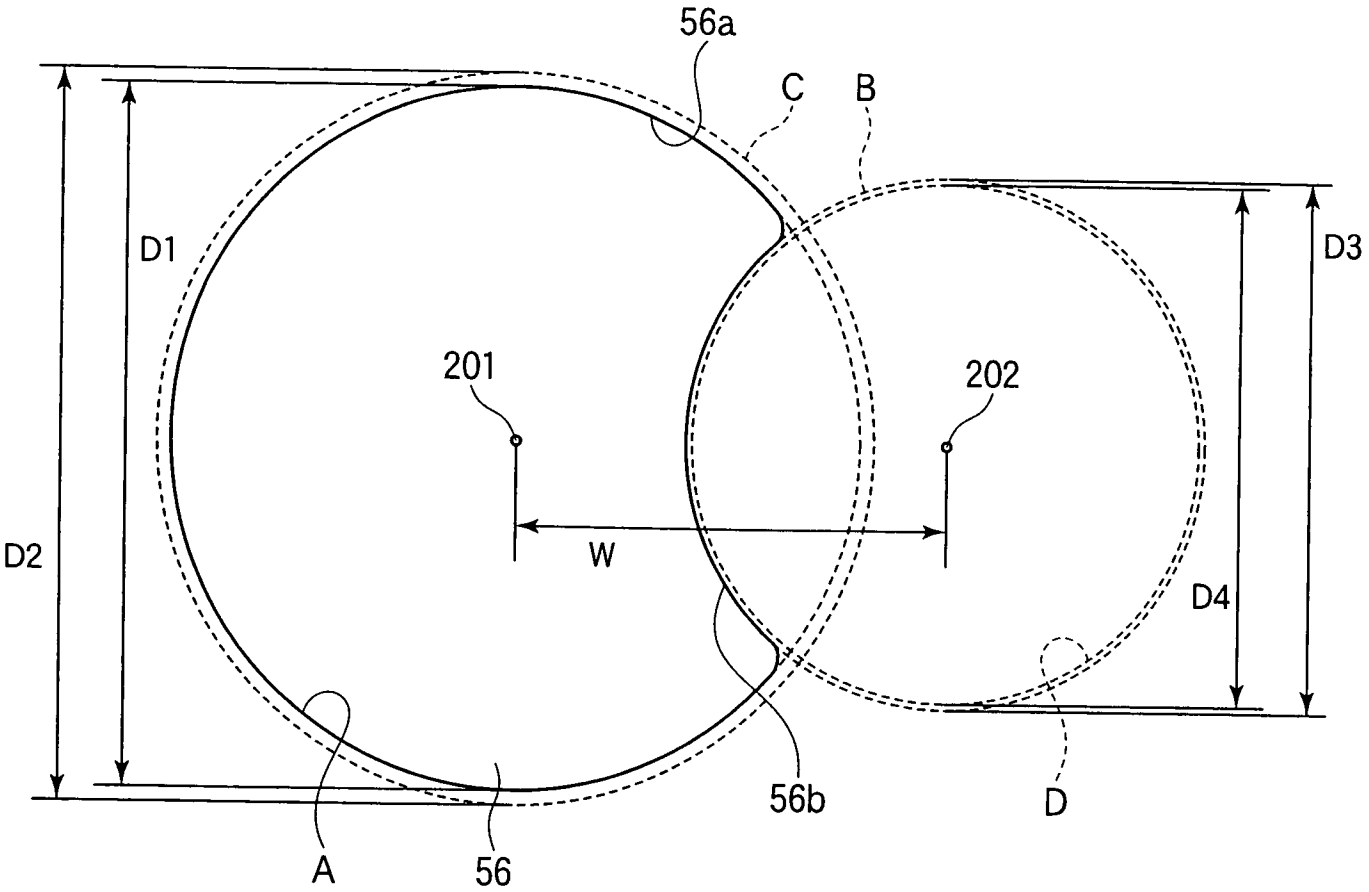
FIG. 12A illustrates various dimensions of a button hole.
Figure 12B:
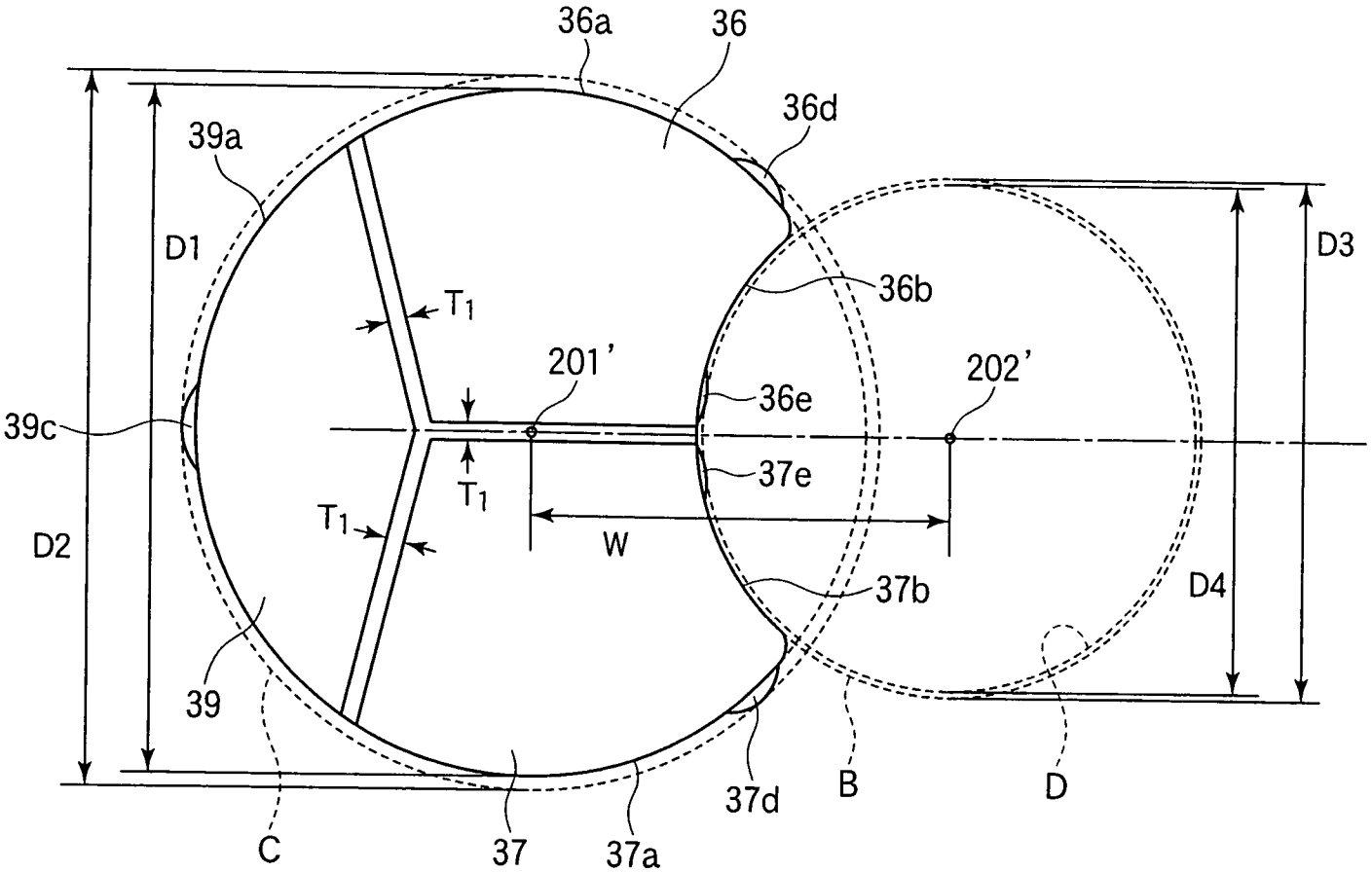
FIG. 12B illustrates various dimensions of an upper menu key, a lower menu key, and a back key before the button key assembly has been assembled to the case.
Figure 12C:
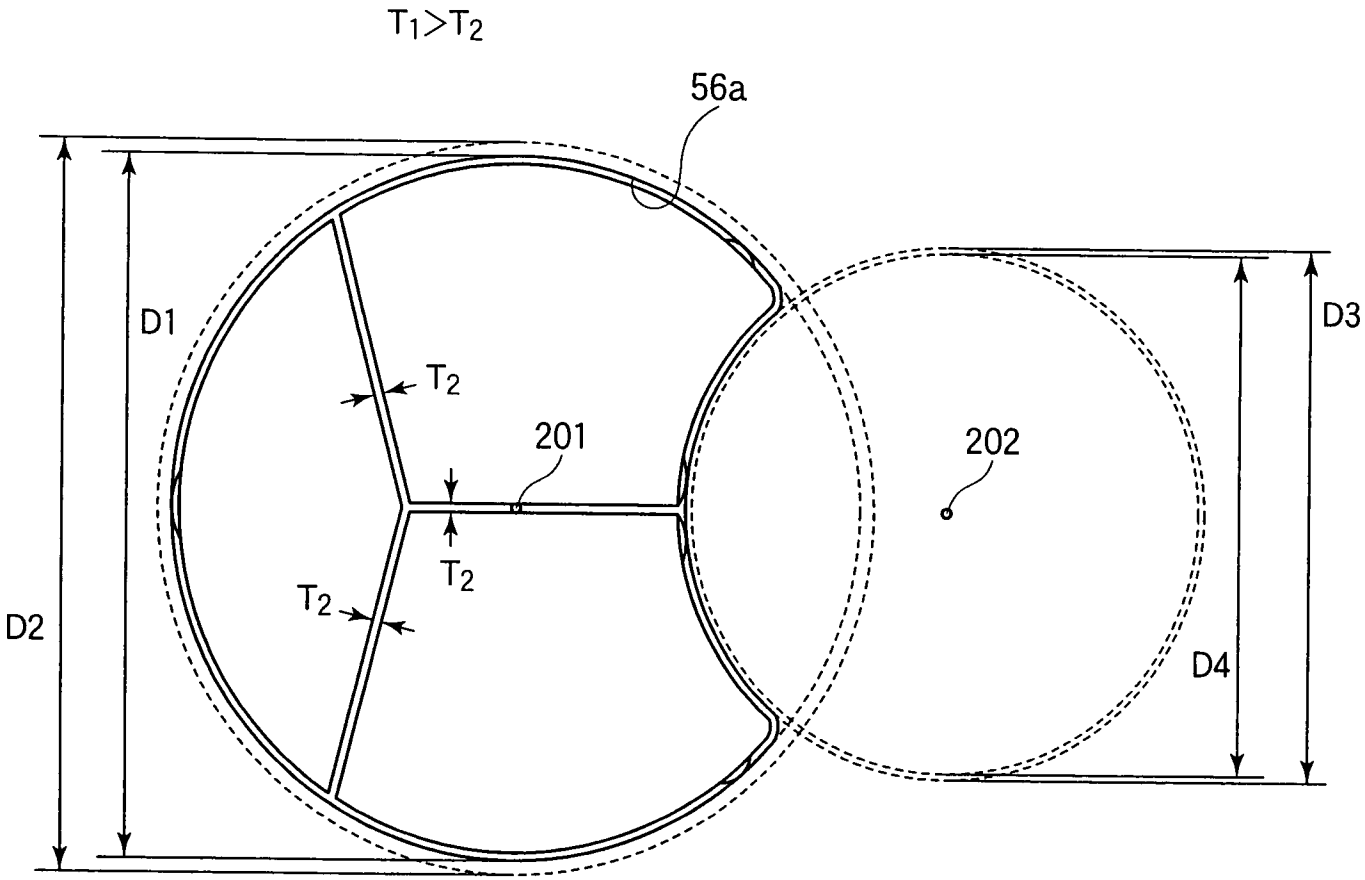
FIG. 12C illustrates the positional relationship among the upper menu key, lower menu key and back key after the button key assembly has been assembled to the case.

The relation between the diameter of the perimeter 56*a* of the button hole 56, and the radii of the upper menu key 36, lower menu key 37, and back key 39 will be described with reference to FIGS. 12A-12C. FIG. 12A illustrates the various dimensions of the button hole 56. FIG. 12B illustrates the various dimensions of the upper menu key 36, lower menu key 37 and back key 39 before the button key assembly 45 has been assembled to the case 33. FIG. 12C illustrates the positional relationship among the upper menu key 36, lower menu key 37 and back key 39 after the button key assembly 45 has been assembled to the case 33.

Referring to FIG. 12A, the perimeter portion 56*a* includes a diameter D1 equivalent to the diameter of an imaginary circle A (centered at "201"), and the perimeter portion 56*b* includes a diameter D3 equivalent to the diameter of an imaginary circle B (centered at "202"). The center-to-center distance W between the two imaginary circles A and B is selected such that the two imaginary circles A and B overlap each other by a predetermined amount.

Referring to FIG. 12B, the upper menu key 36, lower menu key 37, and back key 39 are spaced apart from one another by the first gap T1 (e.g., 0.8 mm) before the button key assembly 45 has been mounted to the case 33, and the side surface 36*a*, side surface 37*a*, and side surface 39*a* have a radius of curvature substantially the same as that of the imaginary circle A having the diameter D1 about the center 201. Further, the abutments 36*d*, 37*d*, and 39*c* project further radially outwardly than the diameter of the perimeter portion 56*a* of the button hole 56, i.e., an imaginary circle C that is circumscribed around the abutments 36*d*, 37*d*, and 39*c* has a diameter D2 slightly larger than the diameter D1. The diameters D, D2, D3, and D4 are 33mm, 33.6 mm, 21.6 mm, and 21 mm in the first embodiment.

The imaginary circle B having the diameter D3 lies on the side surface 36*b* of the upper menu key 36 and the side surface 37*b* of the lower menu key 37. An imaginary circle D that is circumscribed around the abutments 36*e* and 37*e* has a diameter D4 slightly smaller than the diameter D3. In other words, the abutments 36*e* and 37*e* project from the upper menu key 36 and lower menu key 37 radially outwardly from the center 201 further than the perimeter portion 56*b* of the button hole 56 before the button key assembly 45 has been assembled to the case 33. It is to be noted that the upper menu key 36 and lower menu key 37 are on either side of an imaginary plane cutting through the passing through the first and second posts 47 and 48 and generally perpendicular to the front surface of the case 33, and are mirror images of one another. Another way of looking at the assembly is that the upper menu key 36 and lower menu key 37 are symmetrical with respect to a line passing through the centers 201 and 202. Likewise, the back key 39 is symmetrical about the line passing through the centers 201 and 202.

As described above, a second gap T2 smaller than the first gap T1 is maintained between the perimeter portion 56*a* and the surface 36*a*, between the perimeter portion 56*a* and the side surface 37*a*, and between the perimeter portion 56*a* and the side surface 39*a*. The radius of curvature of the perimeter portion 56*b* is substantially equal to that of surface 36*b* and side surface 37*b*. The side surfaces 36*a* and 37*a* may be any shape as long as they do not outwardly extend further from the center 201 than the imaginary circle C having the diameter D2. The side surfaces 36*b* and 37*b* may be of any shape as long as they do not outwardly extend further from the center 201 than the imaginary circle D having the diameter D4.

For example, if the perimeter portion 56*a* of the button hole 56 has a diameter of 33 mm, and the perimeter portion 56*b* of the button hole 56 has a diameter of 21.6 mm, then the side surfaces 36*a*, 37*a*, and 39*a* are designed to have a diameter of 33 mm, the side surfaces 36*b* and 37*b* are designed to have a diameter of 21.6 mm, the abutments 36*d*, 37*d*, and 39*c* are designed to be inscribed in the imaginary circle having a diameter of D2=33.6 mm, and the abutments 36*e* and 37*e* are designed to be on the imaginary circle D having a diameter of D4=21 mm. These diameters are those before the button key assembly 45 has been assembled to the case 33.

The operation of the button keys of the aforementioned configuration will be described.

When a user wants to select, for example, the number of pages to be printed and the type of a medium to be printed on, he depresses the upper menu key 36, lower menu key 37, and back key 39 to select appropriate settings. As described previously, once the first post 47 and the second post 48 have been fittingly received in the circular recess 49 (FIG. 4) and the elongated circular recess 50, respectively, the first post 47 and second post 48 are positioned accurately in a plane normal to the direction in which the operational keys are pressed.

The surfaces of the abutments 36*d*, 37*d*, and 39*c* are inscribed in the imaginary circle C having the diameter D2 larger than the diameter of the perimeter portion 56*a*. Therefore, when the upper menu key 36, lower menu key 37, and back key 39 are inserted in the button hole 56, the abutments 36*d*, 37*d*, and 39*c* abut the perimeter portion 56*a* of the button hole 56. Because the surfaces of the abutments 36*e* and 37*e* are on the circumference of the imaginary circle D having a diameter D4 smaller than the perimeter portion 56*b* of the button hole 56, the abutments 36*e* and 37*e* are pressed against the perimeter portion 56*b* of the button hole 56.

When the button key assembly 45 has been assembled to the case 33, the upper menu key 36, lower menu key 37, and back key 39 are pushed by the perimeter portions 56*a* and 56*b* in the U1 and U2 directions, L1 and L2 directions, and B1 direction, respectively, as shown in FIG. 10. Thus, the knee bends 36*k*, 36*n*, 36*m*, 37*k*, 37*n*, 37*m*, 39*f*, 39*g*, 39*h*, and 39*i* resiliently deform such that the upper menu key 36, lower menu key 37, and back key 39 are displaced in such directions as to reduce the gap between adjacent ones of these keys from the first gap T1 (e.g., approx. 0.8 mm) to the second gap T2 (e.g., approx. 0.2 mm).

Once the upper menu key 36, lower menu key 37, and back key 39 have been assembled to the case 33, the second gap T2 between adjacent ones of these keys 36, 37, 39 is smaller than the first gap T1 (e.g., 0.8 mm), the difference in gap being equal to the difference between the diameter of the button hole 56 and the diameter of the imaginary circle C in which the abutments 36*d*, 36*e*, 37*d*, 37*e*, and 39*c* are inscribed. The decrease in the gap in this manner is effective in minimizing rattling of the operational keys after the button key assembly 45 has been assembled to the case 33. The difference is approx. 0.6 mm, providing that the perimeter portions 56*a* and 56*b* have diameters of 33 mm and 21.6 mm, respectively, and the abutments 36*d*, 37*d*, and 39*c* are inscribed in the imaginary circle C having a diameter of 33.6 mm, and the surfaces of abutments 36*e* and 37*e* are on the circumference of the imaginary circle D having an outer diameter of 21 mm.

In the first embodiment, the abutments 36*d*, 36*e*, 39*c*, 37*d*, 37*e* of the respective operational keys abut the perimeter portions 56*a* and 56*b* of the button hole 56, thereby decreasing the gaps from the first gap T1 to the second gap T2. However, the invention is not limited to this. For example, the abutments of the respective operational keys may abut other portions of the case 33 than the perimeter portions 56*a* and 56*b* of the button hole 56, so that the first gaps T1 decrease to the second gaps T2.

As described above, when the upper menu key 36, lower menu key 37, and back key 39 have been inserted into the button hole 56, the abutment 36*d*, 36*e*, 37*d*, 37*e*, and 39*c* abut the perimeter portions 56*a* and 56*b*, so that the gaps between adjacent ones of the upper menu key 36, lower menu key 37, and back key 39 may be decreased from the first gap T1 to the second gap T2. Thus, the rattling of the operational keys due to the smaller second gaps T2 between adjacent ones of the operational keys is minimized. For example, the configuration is effective in minimizing the rattling of the operational keys in directions perpendicular to the direction in which the operational keys are depressed, thereby improving the operability of the operational keys.

The first embodiment allows the operational keys to be spaced apart by the sufficiently large gap (e.g., T1 shown in FIG. 7) during the manufacture of the button key assembly 45 by molding. Thus, the mold for molding the operational keys may be designed to have sufficient mechanical strength.

Second Embodiment

Figure 13:
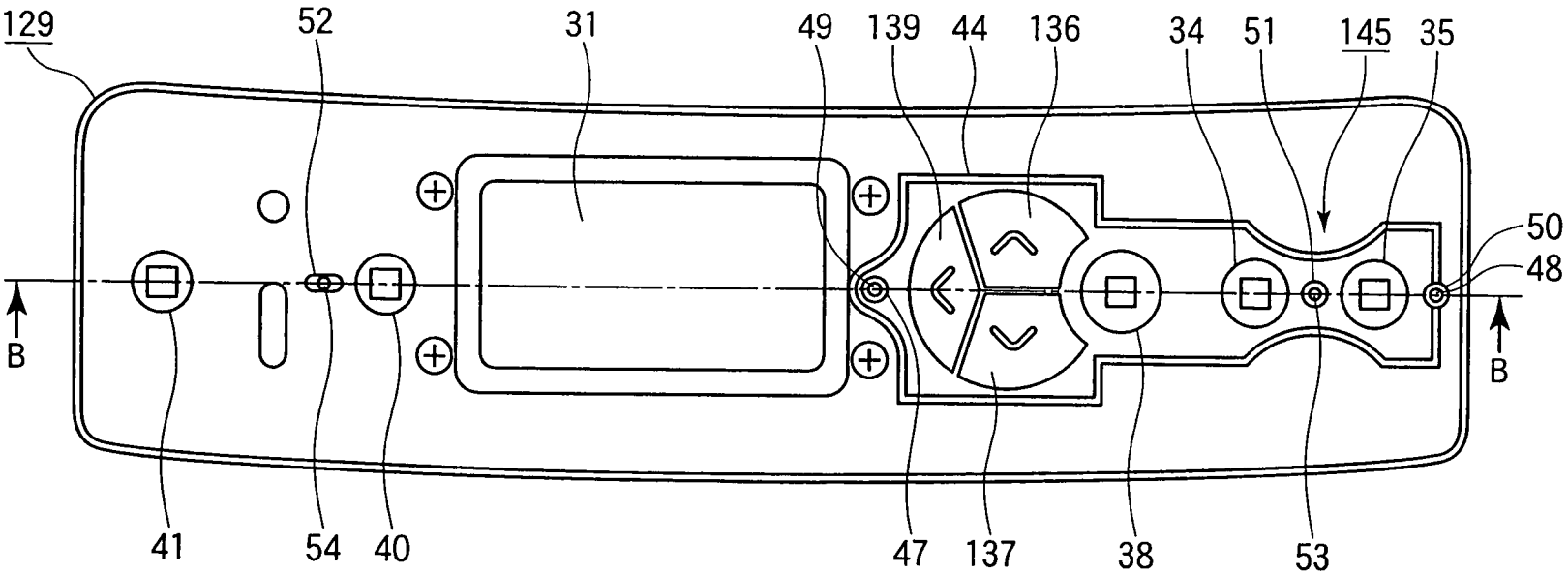
FIG. 13 is a front view illustrating an operator panel of a second embodiment.

FIG. 13 is a front view illustrating an operator panel 129 of a second embodiment.

Figure 14:
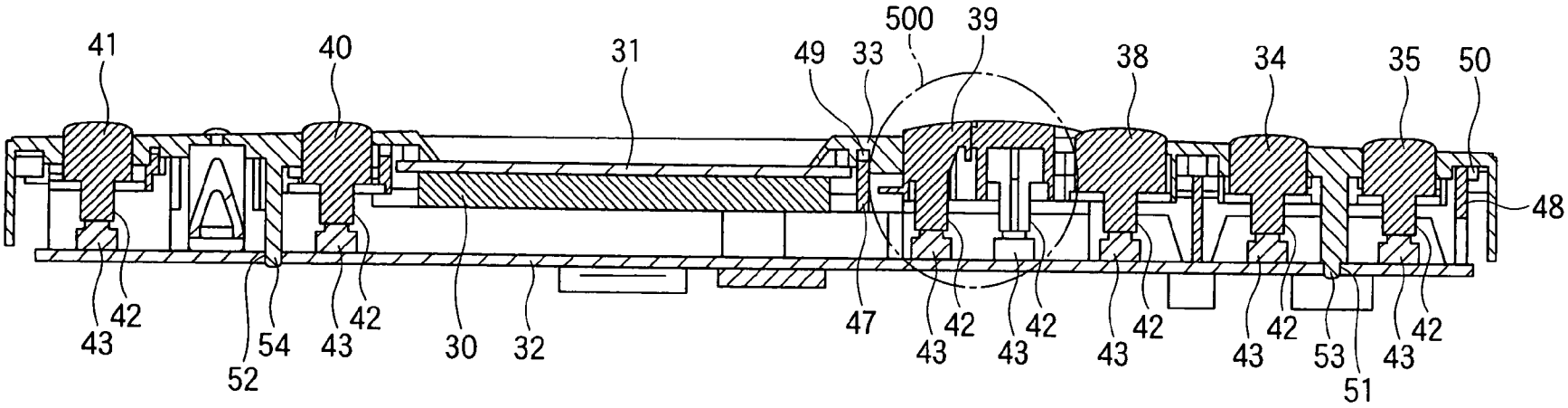
FIG. 14 is a cross-sectional view taken along a line B-B of FIG. 13.

FIG. 14 is a cross-sectional view taken along a line B-B of FIG. 13.

Figure 15:
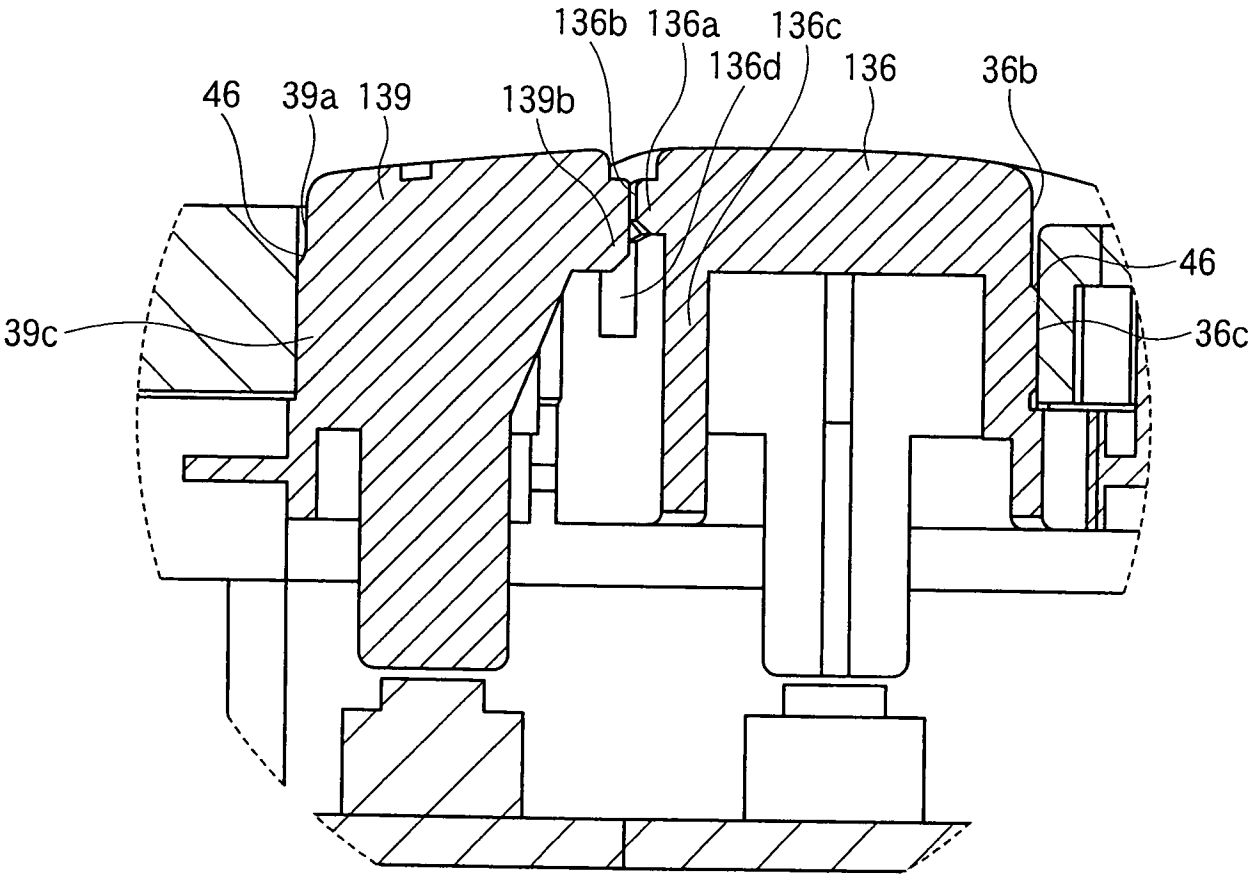
FIG. 15 is a partial expanded view of an area shown by a dot-dash line shown in FIG. 13.

FIG. 15 is a partial expanded view of an area depicted at 500 shown in FIG. 13.

Figure 16:
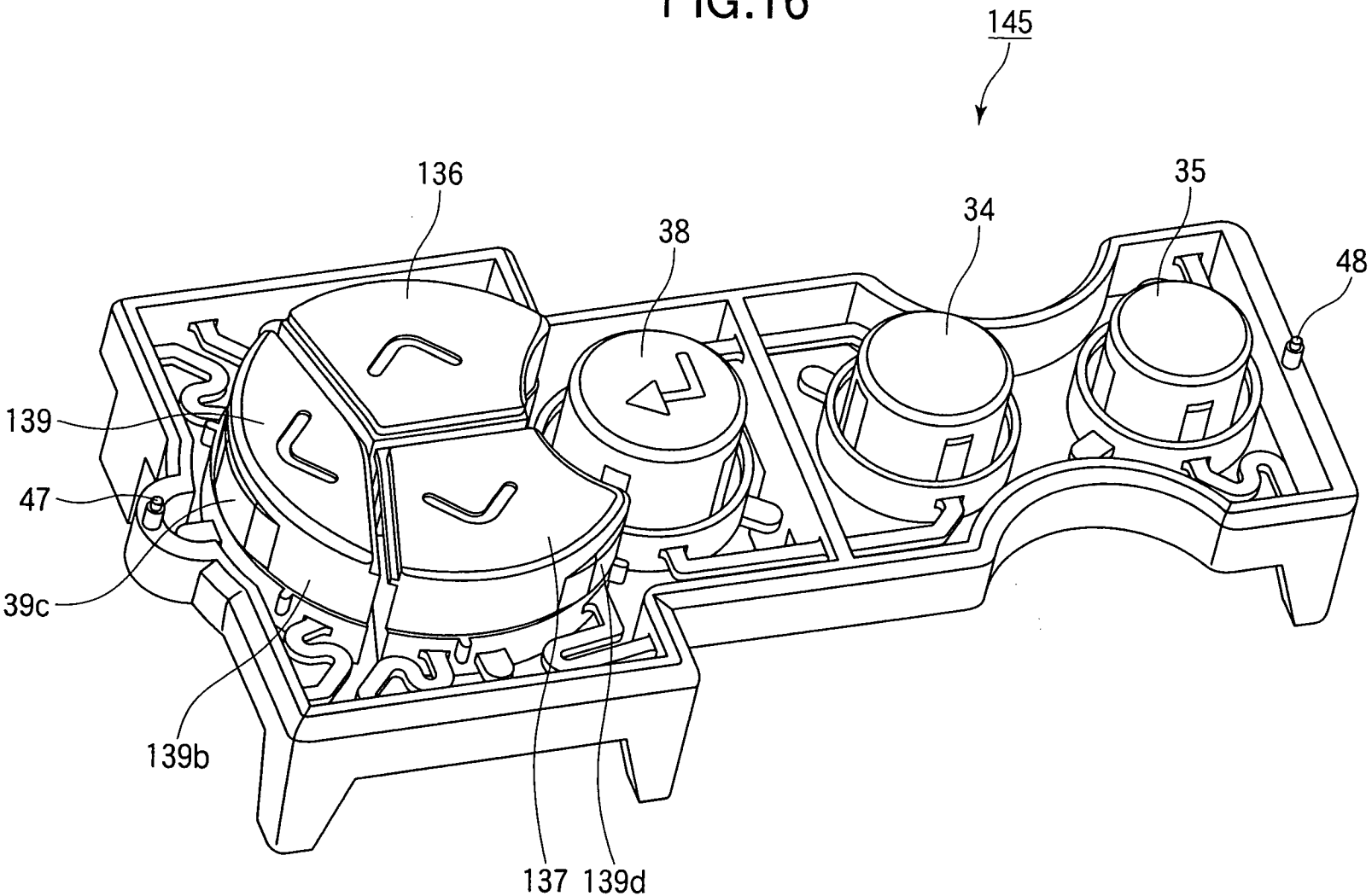
FIG. 16 is a perspective view of a button key assembly of the second embodiment as seen obliquely from above.

FIG. 16 is a perspective view of a button key assembly 145 as seen obliquely from above.

Figure 17:
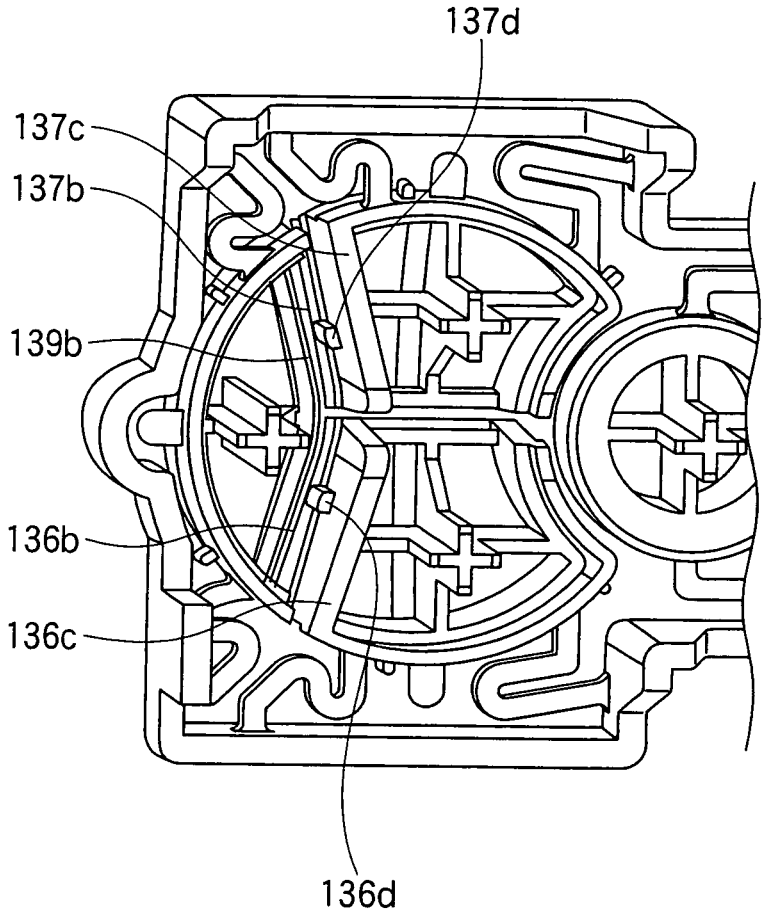
FIG. 17 is a perspective view of the button key assembly as seen obliquely from under.

FIG. 17 is a perspective view of the button key assembly 145 as seen obliquely from under.

Referring to FIG. 13, the operator panel 129 differs from the operator panel 29 in the configuration of an upper menu key 136, a lower menu key 137, and a back key 139. Elements similar to those in the first embodiment have been given the same reference numerals and their description is omitted. The configuration of the image forming apparatus 1 of the second embodiment is the same as that of the image forming apparatus 1 of the first embodiment except for the operator panel 129. Thus, the second embodiment will be described with reference to FIG. 1 as required.

Just as in the first embodiment, the upper menu key 136 and lower menu key 137 are on either side of an imaginary plane cutting through the passing through the first and second posts 47 and 48 and generally perpendicular to the front surface of the operator panel 129, and are mirror images of one another. Another way to look at this configuration is that the upper menu key 136 and lower menu key 137 are symmetrical with respect to an imaginary plane generally perpendicular to the front surface of the operator panel 129. The back key 139 is also symmetrical with respect to the imaginary plane. Referring to FIGS. 15-17, the upper menu key 136 includes a projection 136*a* that extends over a distance substantially equal to a half of the thickness of an upper portion of the upper menu key 136, extending in a direction in which the upper menu key 136 is pressed. There is a predetermined gap or a first gap T1 (e.g., 0.8 mm) between a projection 139*b* of the back key 139 and a side surface 136*b* of the upper menu key 136. The upper menu key 136 includes a side surface 136*c* that extends from the projection 136*a* in a direction parallel to the direction in which the upper menu key 136 is pressed. The side surface 136*c* is further away from the projection 139*b* than the side surface 136*b*.

The upper menu key 136 further includes a rib 136*d* formed on the side surface 136*c*, the rib 136*d* extending from the projection 136*a* in the direction in which the upper menu key 136 is pressed. The rib 136*d* includes a surface flush with the side surface 136*b* of the back key 139. In other words, the surface of the rib 136*d* and the side surface 136*b* lie in the same plane.

The operation of the button keys of the aforementioned configuration will be described.

In the first embodiment, once the button key assembly 45 has been assembled to the case 33, the second gap T2 is only about 0.2 mm. Therefore, when the user depresses the back key 39, the back key 39 is difficult to move while maintaining this small gap T2. As the back key 39 moves, the back key wall portion 39*b* slides on the upper menu key wall 36*c* and the lower menu key wall 37*c*.

In the second embodiment, the first gap T1 between adjacent ones of the upper menu key 136, lower menu key 137, and back key 139 is defined by the projection 139*b*, the side surfaces 136*b* and 137*b*. In addition, the rib 136*d* is flush with the side surface 136*b*, and extends in a direction parallel to the direction in which the back key 139 is pressed. The rib 137*d* is also flush with the surface 137*b*, and extends in a direction parallel to the direction in which the back key 139 is depressed. When the back key 139 is depressed, the projection 139*b* slides on the rib 136*d* and the rib 137*d*. The remaining portion of the operation is the same as that described in the first embodiment, and the description thereof is omitted.

When one of the upper menu key 136, lower menu key 137, and back key 139 is pressed, the pressed key moves while being in contact with the adjacent keys. It is to be noted that the pressed key has a smaller total area in contact with the adjacent keys in the second embodiment than in the first embodiment.

As described above, the configuration of the button key assembly 145 provides substantially the same advantages as the button key assembly 45 of the first embodiment. The smaller total area of an operational key in contact with the adjacent keys is effective in minimizing the friction between the pressed operational key and the adjacent operational keys, thus facilitating the smooth movement of the pressed operational key. Thus, the configuration of the second embodiment improves the ease of operation of the operational keys.

The first gap T1 defined between upper menu key 136 and the back key 139, and the first gap T1 defined between the lower menu key 137 and the back key 139 do not extend over a great depth, eliminating extremely thin portions of a mold so that the usable lifetime of the mold may be prolonged.

While the embodiments have been described in terms of three operational keys, i.e., upper menu key, lower menu key and back key, the invention is not limited to this. While the operational keys form a generally cylindrical appearance when they are assembled together, the invention is not limited to this. The adjacent operational keys may have any shape.

Although the embodiments have been described with respect to an operator panel of an image forming apparatus, the invention may also be applicable to copying machines, printers, facsimile machines, personal computers, telephones, and gaming machines.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A button key assembly, comprising:

a frame;

a plurality of button keys connected to said frame via a plurality of resilient supports such that said plurality of button keys are resiliently movable, wherein said plurality of resilient supports, said plurality of button keys, and said frame are integrally formed, and each of said plurality of button keys includes an engagement portion that projects therefrom; and a case including a button hole formed therein, said case being assembled to said frame such that said plurality of button keys are received in the button hole;

wherein said plurality of button keys are spaced apart by a first gap before said plurality of button keys have been received in the button hole;

wherein said plurality of button keys are spaced apart by a second gap after said case has been assembled to said frame such that said plurality of button keys are received in the button hole and such that the engagement portion abuts an inner wall of the button hole, the second gap being smaller than the first gap; and wherein the engagement portion projects in a direction substantially perpendicular to a direction in which said plurality of button keys are depressed.

2. The button key assembly according to claim 1, wherein each of the plurality of resilient supports includes at least one bent portion.

3. The button key assembly according to claim 1, wherein at least one of the plurality of button keys includes a surface facing the other of the button keys, the surface including a rib formed thereon and extending in a direction substantially parallel to a direction in which the button keys are depressed.

4. An electronic apparatus incorporating the button key assembly according to claim 1.

5. An image forming apparatus incorporating the button key assembly according to claim 1.

6. A button key assembly, comprising:

a frame:

a plurality of button keys connected to said frame via a plurality of resilient supports such that said plurality of button keys are resiliently movable, wherein said plurality of resilient supports, said plurality of button keys, and said frame are integrally formed, and each of said plurality of button keys includes an engagement portion that projects therefrom; and a case including a button hole formed therein, said case being assembled to said frame such that said plurality of button keys are received in the button hole;

wherein said plurality of button keys are spaced apart by a first gap before said plurality of button keys have been received in the button hole;

wherein said plurality of button keys are spaced apart by a second gap after said case has been assembled to said frame such that said plurality of button keys are received in the button hole and such that the engagement portion abuts an inner wall of the button hole, the second gap being smaller than the first gap; and wherein each of the plurality of resilient supports includes at least one bent portion.

7. The button key assembly according to claim 6, wherein at least one of the plurality of button keys includes a surface facing the other of the button keys, the surface including a rib formed thereon and extending in a direction substantially parallel to a direction in which the button keys are depressed.

8. An electronic apparatus incorporating the button key assembly according to claim 6.

9. An image forming apparatus incorporating the button key assembly according to claim 6.

10. A button key assembly, comprising:

a frame:

a plurality of button keys connected to said frame via a plurality of resilient supports such that said plurality of button keys are resiliently movable, wherein said plurality of resilient supports, said plurality of button keys, and said frame are integrally formed, and each of said plurality of button keys includes an engagement portion that projects therefrom; and a case including a button hole formed therein, said case being assembled to said frame such that said plurality of button keys are received in the button hole;

wherein said plurality of button keys are spaced apart by a first gap before said plurality of button keys have been received in the button hole;

wherein said plurality of button keys are spaced apart by a second gap after said case has been assembled to said frame such that said plurality of button keys are received in the button hole and such that the engagement portion abuts an inner wall of the button hole, the second gap being smaller than the first gap; and wherein at least one of the plurality of button keys includes a surface facing the other of the button keys, the surface including a rib formed thereon and extending in a direction substantially parallel to a direction in which the button keys are depressed.

11. The button key assembly according to claim 10, wherein each of the plurality of resilient supports includes at least one bent portion.

12. An electronic apparatus incorporating the button key assembly according to claim 10.

13. An image forming apparatus incorporating the button key assembly according to claim 10.

* * * * *